US010876742B2

(12) United States Patent
Tadmor

(10) Patent No.: US 10,876,742 B2
(45) Date of Patent: Dec. 29, 2020

(54) SABBATH CONTROLLER FOR A HOT WATER TANK

(71) Applicant: Ronen Tadmor, Montreal (CA)

(72) Inventor: Ronen Tadmor, Montreal (CA)

( * ) Notice: Subject to any disclaimer, the term of this patent is extended or adjusted under 35 U.S.C. 154(b) by 362 days.

(21) Appl. No.: 15/901,172

(22) Filed: Feb. 21, 2018

(65) Prior Publication Data

US 2018/0245802 A1 Aug. 30, 2018

(30) Foreign Application Priority Data

Feb. 24, 2017 (GB) ..... 1703045.3

(51) Int. Cl.

| | |
|---|---|
| ***F24D 19/10*** | (2006.01) |
| ***F24H 9/20*** | (2006.01) |
| ***H05B 1/02*** | (2006.01) |
| ***F24D 17/00*** | (2006.01) |

(52) U.S. Cl.

CPC ..... *F24D 19/1051* (2013.01); *F24D 17/0078* (2013.01); *F24H 9/2021* (2013.01); *H05B 1/0244* (2013.01); *F24D 2220/042* (2013.01); *F24D 2220/044* (2013.01)

(58) Field of Classification Search

CPC ..... F24D 17/0078; F24D 2220/042; F24D 2220/044; F24H 9/2021; H05B 1/0244

USPC ..... 392/441, 445, 463, 456, 496; 236/12.11, 236/12.12, 12.13; 122/14.1, 14.3; 137/334

See application file for complete search history.

(56) References Cited

U.S. PATENT DOCUMENTS 4,641,011 A * 2/1987 Roberts ..... A47J 31/007 219/508
5,317,670 A * 5/1994 Elia ..... F24D 19/1051 126/362.1
5,367,602 A * 11/1994 Stewart ..... F24D 17/02 237/2 B
5,459,890 A * 10/1995 Jarocki ..... G05D 23/1393 122/13.3
5,701,387 A * 12/1997 McGugan ..... F24D 17/0073 122/13.3

(Continued)

FOREIGN PATENT DOCUMENTS

IL 54125 A 9/1980
WO WO 2014/136109 A1 9/2014

OTHER PUBLICATIONS

Search Report dated Aug. 22, 2017 in corresponding United Kingdom Patent Application No. GB1703045.3.

*Primary Examiner* — Jimmy Chou
(74) *Attorney, Agent, or Firm* — Ostrolenk Faber LLP

(57) ABSTRACT

A water heating control system has a tank for holding a volume of water heated by a heater and having a hot water outlet and a cold water inlet connected to a main water supply whereby hot water removed from the hot water outlet is replenished with cold water. A temperature sensor provides a temperature signal indicative of water temperature in the tank, and a control unit monitors the water temperature based on the temperature signal and is responsive to selection of a Sabbath mode of operation for periodically actuating and de-actuating the heater while maintaining an average water temperature to less than a permitted preset threshold. In Sabbath mode the control unit closes a shut off valve connected to the water inlet when the heater is actuated and opens the shut off valve when the heater is not actuated.

21 Claims, 1 Drawing Sheet

(56) References Cited

U.S. PATENT DOCUMENTS 5,808,278 A * 9/1998 Moon ..... A47G 33/00 200/43.01
5,841,112 A * 11/1998 Brooks ..... G05B 19/042 219/506
6,167,845 B1 * 1/2001 Decker, Sr. ..... F24H 1/202 122/14.1
7,672,576 B2 * 3/2010 Grossbach ..... F24D 17/0031 392/441
7,934,662 B1 * 5/2011 Jenkins ..... G05D 23/1326 236/12.1
7,974,527 B1 * 7/2011 Adler ..... F24H 1/185 392/450
8,406,932 B2 * 3/2013 Hollaway ..... A61H 33/005 219/437
9,321,623 B2 * 4/2016 Raoven ..... B67D 3/0045
9,442,499 B2 * 9/2016 Fildes ..... G05D 23/1905
10,323,859 B2 * 6/2019 Alsadah ..... F24H 4/04
2007/0051819 A1 * 3/2007 Isaacson ..... F23N 1/082 236/20 R
2007/0103887 A1 * 5/2007 Bleier ..... H01H 13/18 362/92
2007/0158335 A1 * 7/2007 Mansbery ..... F24C 7/082 219/505
2007/0261561 A1 * 11/2007 Grossbach ..... F24D 19/1051 99/275
2009/0103907 A1 * 4/2009 Nave ..... F24D 19/1051 392/463
2012/0181266 A1 * 7/2012 Frommer ..... F24C 3/12 219/492
2013/0193221 A1 * 8/2013 Buescher ..... H05B 1/0297 237/8 A
2014/0166447 A1 * 6/2014 Thea ..... H05B 47/16 200/19.01
2014/0190990 A1 * 7/2014 Raoven ..... B67D 3/0045 222/54
2015/0013622 A1 * 1/2015 Farris ..... G05D 23/1366 122/14.1
2015/0114316 A1 * 4/2015 Wang ..... F25B 13/00 122/15.1

* cited by examiner

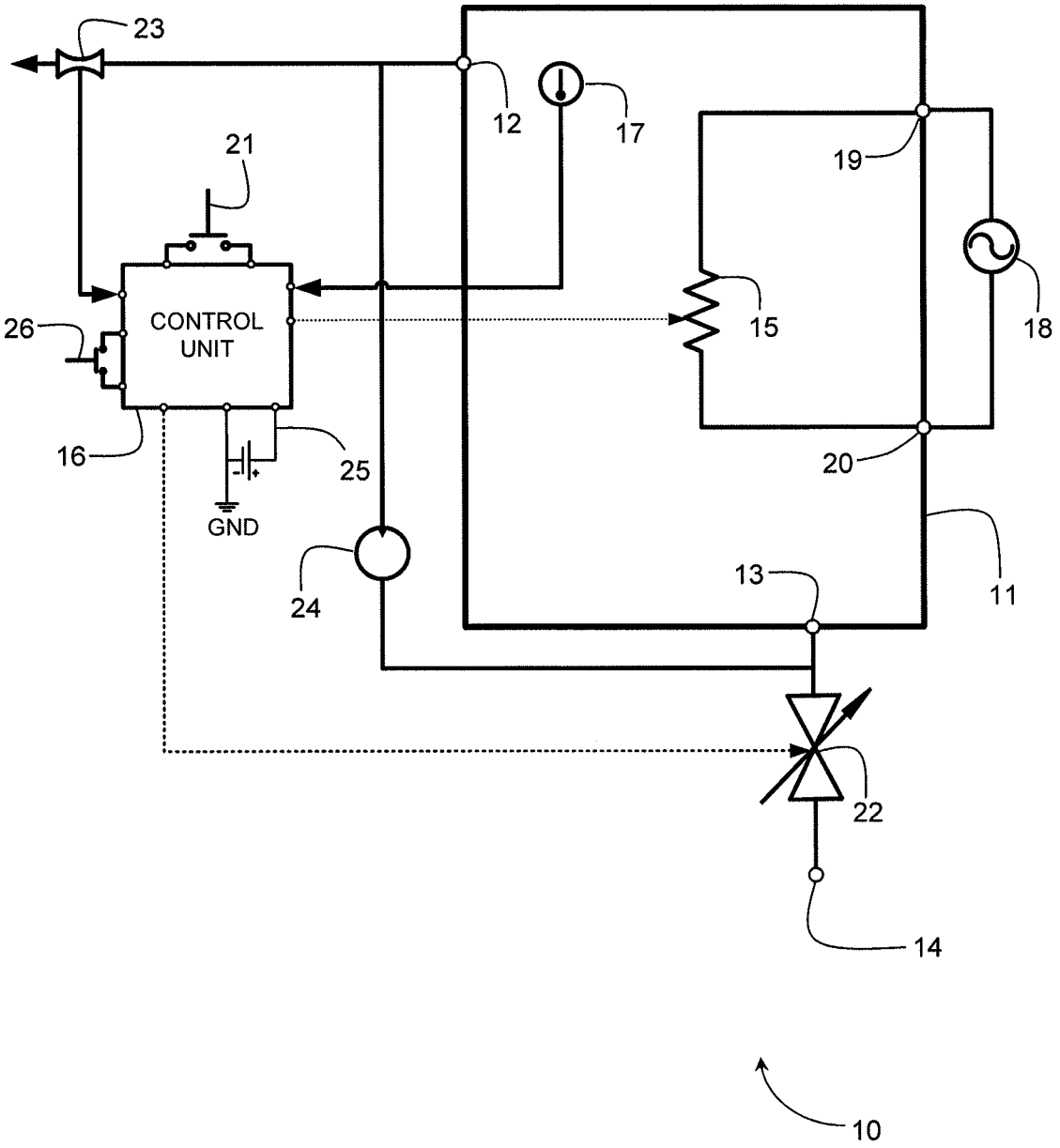
23
12
17
21
19
CONTROL
UNIT
26
15
18
16
25
20
GND
24
13
11
22
14
10

SABBATH CONTROLLER FOR A HOT WATER TANK

FIELD OF THE INVENTION

This invention relates to a temperature controller for maintaining the water temperature in a water tank less than a specified upper threshold.

BACKGROUND OF THE INVENTION

Jewish law prohibits the heating of liquids on the Sabbath beyond a threshold temperature of about 40° C., such heating being defined as cooking, which is proscribed on the Sabbath. On the other hand, heating water on the Sabbath to a temperature that is less than 40° C. is permitted. Complementary to this restriction, water may be heated to a much higher temperature, say close to 100° C. before the onset of the Sabbath and the high temperature (way above 40° C.) may be maintained on the Sabbath. However, most authorities will permit this only if the water is heated constantly rather than intermittently using a thermostat. The reason for this is that a thermostat induces operation of the heater and is liable to be triggered into operation by the very act of drawing hot water from the tank. In such case, the user would inadvertently be activating the heater on the Sabbath, which is proscribed. On the other hand, if the water is being heated at low power constantly for the whole of the Sabbath, then the user's drawing hot water from the tank in no way affects the heating and this is permitted.

This principle is employed in most Sabbath hot water urns that store a fairly large volume, typically 30-60 liters, of hot water. They have two switches, one of which is operated before the Sabbath to bring the water to the boil, when the first switch is moved to the 'off' position and the other is switched 'on' to activate a low power heater for the full duration of the Sabbath.

The present invention is directed to hot water tanks rather than electric urns, but the above introduction in Jewish law is important to understand the distinction between the invention and the prior art.

US20070051819 discloses a controller for monitoring a domestic water tank and switching between a high temperature mode of operation and a low temperature mode of operation. During the low temperature mode of operation, the controller maintains the water temperature within a range of between 105 and 113° F. i.e. 40.5 to 45° C. Particular reference is made to paragraphs [0017] to [0023]. The controller avoids heating liquids beyond the permitted threshold temperature on the Sabbath.

U.S. Pat. No. 7,672,576 discloses a water dispenser having a Sabbath function, wherein water refill of the hot water reservoir tank is prevented and the heating of the water in the hot reservoir tank is modified to provide a constant heating at a less than boiling temperature. It should be noted that in this patent the water is heated to a high temperature before the onset of the Sabbath and is maintained at this temperature throughout the Sabbath by a low power heater that is operated constantly. In Sabbath mode, cold water flow into the tank is disabled. The reason for this is that otherwise cold water entering the tank to replace hot water drawn off by the user would become heated by the hot water remaining in the tank and by the water heater. If the temperature of this cold water rose above approximately 40° C., this would violate Sabbath law. However, once the cold water inlet to the tank is sealed, the hot water tank operates exactly like a conventional Sabbath urn, as described above, except that instead of sitting on the kitchen sink it sits on the roof of a house.

Mention should also be made of a device sold under the tradename ShabbHOT™, details of which can be found at http://www.sterlingwaterheaters.com/. It appears that their device is the same as, or similar in operation to, the device described in US20070051819 in that it heats the water to a temperature slightly less than 40° C., which is permissible on the Sabbath. According to their website the device uses a double random control process, thus removing the operation of the system from being a direct action of hot water usage. What this means is that the heating of the water is not a direct function of drawing off water so that the heating cannot be directly attributed to the action of the user.

It is obviously appreciated that the niceties of Jewish law do not generally impact the patentability of an invention. Novelty and inventive step are assessed on the merits based on what is already known. But in assessing inventive step or obviousness, there has to be reason or motivation to combine two (or more) prior art references and it is therefore important at the outset to understand that the principles of Jewish law that underpin the above two devices are fundamentally different and address two quite different issues. Thus, on the one hand, US20070051819 and ShabbHOT™ address the requirement to provide hot water that is heated on the Sabbath but in a manner that is permissible since its temperature does not rise above 40° C. On the other hand, U.S. Pat. No. 7,672,576 addresses a different issue that even water that is heated before the onset of the Sabbath may not be used if the use of that water would induce the flow of cold water that would then be heated to above 40° C.

The reason why these issues are different is that if water is heated before the onset of the Sabbath to above 40° C. as in U.S. Pat. No. 7,672,576, then the only way to render this water usable on the Sabbath in accordance with the strictest of opinions is to prevent the inflow of cold water. But if the water can never be heated above 40°, then there is no need or reason to prevent the inflow of cold water. This distinction also plays out in the nature of the products, which are different both in use and construction. Specifically, US20070051819 and ShabbHOT™ address the need for a large and unlimited volume of water on the Sabbath for the purpose of washing dishes, washing one's hands and face, showering (some authorities do not permit bathing or showering on the Sabbath, but their concern is not specifically related to the water temperature and therefore their concerns are beyond the scope of this discussion). U.S. Pat. No. 7,672,576 address the different need to provide a limited quantity of almost boiling hot water on the Sabbath. To be sure, a water tank on the roof provides a vastly larger quantity of piping hot water than a Sabbath urn that holds a mere 50 l of water. But as noted above the principle of operation appears to be identical.

US20070051819 and ShabbHOT™ are both subject to the following drawbacks. First, precisely because heating is randomized and not conditional on actual water usage, it is possible for a householder to draw water from the tank during a heating cycle. There is no problem in Jewish law in doing this because in any case the water temperature is maintained to less than 40° C., which is permissible. But the energy used to heat the water is largely wasted because instead of being used to maintain the 40° C. temperature of the water in the tank, whose use is now required, it ends up being used to heat incoming water.

Secondly, in normal use of hot water systems, cold water always replenishes the outgoing hot water. Indeed, usually it is the pressure of the cold water inlet that causes the hot water to circulate. This is avoided in U.S. Pat. No. 7,672,576 by using a closed tank whose water inlet is shut off in Sabbath mode for the complete duration of the Sabbath. In such an arrangement, hot water flow through a spout located toward the bottom of the tank so as to allow water to flow under hydrostatic pressure. Unless the water inlet is shut off, the hot water in the tank, whose temperature is much higher than 40° C., will heat incoming cold water above 40° C., which is prohibited. In ShabbHOT™ and US20070051819 there is no need to avoid the inflow of cold water because at no time is water heated beyond 40° C. As a result, the act of drawing off hot water does cause cold water to enter the tank and replace the hot water as it is removed. While this is permissible under Jewish law, it nevertheless means that during the act of using hot water, it is being constantly cooled down by the inflow of cold water. So here again the hot water temperature drops and during protracted use of hot water, for example, when washing dishes, the temperature of the water is liable to fall markedly from an initial 40° C., which is comfortable, to a significantly lower temperature.

U.S. Pat. Nos. 5,459,890 and 7,934,662 disclose programmable water heaters, which mix hot and cold water to achieve a desired temperature. The hot and cold water are mixed in a mixing chamber to achieve a set temperature. Also, as shown in FIG. 4 of U.S. Pat. No. 7,672,576, two reservoirs may be employed in only one of which water is heated in Sabbath mode and a pump circulates water between the two reservoirs.

IL 54125 discloses a hot water boiler for Sabbath use that operates completely differently to the present invention. No temperature sensor is described and although an optional thermostat may be provided the only concern regarding temperature is that the temperature of the heating element does not exceed 400° C. Water is heated to boiling point and the resulting hot water is percolated into an auxiliary tank located inside the main cold water tank from which boiling water may then be drained. The only temperature control provided is that the heating elements (electrodes) are not energized unless they are below the water level. It is questionable as to whether such an approach is permissible since water is heated from cold to boiling point, which is not permitted on the Sabbath. But in any event, there is no suggestion to avoid heating water above a permitted threshold temperature.

Other hot water systems intended to be Sabbath-compliant are also disclosed in US 2009/103907, WO 2014/136109 and US 2014/190990.

SUMMARY OF THE INVENTION

The above drawbacks are addressed by the invention, according to which there are provided a water heating control system and a control unit for use therewith having the features of the respective independent claims.

The invention relates to the need to provide an unlimited quantity of hot water that may be used on the Sabbath and is thus of the same genre as US20070051819. However, in order to improve efficiency, the water-inlet valve is shut off while water is being heated. Optionally the device uses a water circulation pump for better performance in heating the water within the tank and for improving accuracy of temperature measurement.

BRIEF DESCRIPTION OF THE DRAWINGS

In order to understand the invention and to see how it may be carried out in practice, embodiments will now be described, by way of non-limiting example only, with reference to the accompanying drawings, in which:

FIG. 1 is a schematic representation of a hot water tank heating system with a Sabbath controller according to an embodiment of the invention.

DETAILED DESCRIPTION

Referring to FIG. 1 there is shown schematically a water heating control system 10 comprising a tank 11 for holding a volume of water. The tank 11 has a hot water outlet 12 and a cold water inlet 13 connected to a main water supply 14. Water in the tank 11 is heated by a heater 15 and water temperature is controlled by a control unit 16 in response to a temperature signal indicative of water temperature generated by a temperature sensor 17. The heater 15 is powered by an electrical supply 18 connected to the heater via terminals 19 and 20. The control unit has a mode selector 21 for selecting regular use or Sabbath use. It is noted that the mode selector 21 is shown schematically as a manual set-switch by way of example and illustration. In practice, it may be implemented by a fully automatic programmed timer that is responsive to calendrical data relating to the start and end times of the Sabbath according to time of year and geographical location for setting and terminating Sabbath mode. Such an arrangement is described at col. 5, line 35ff of U.S. Pat. No. 7,672,576 and in paragraph [0022] of US 2007/0051819. In Sabbath mode, water temperature is prevented from rising above a permitted preset threshold, which is typically slightly less than 40° C. During regular use, the water is heated normally in conventional manner. A controllable shut off valve 22 connected between the water inlet 13 and the main water supply 14. During normal use, the shut off valve 22 may be left open so that hot water drawn from the tank is constantly replenished by cold water from the main water supply.

During Sabbath mode, the control unit 16 periodically actuates and de-actuates the heater 15 while maintaining an average water temperature to less than the permitted preset threshold. The control unit 16 is further configured to close the shut off valve 22 when the heater 15 is actuated and to open the shut off valve 22 otherwise, thus avoiding heating water while hot water is being drawn from the tank, when the heating is largely wasted. Preferably, this control feature is independent of whether regular or Shabbat mode is operational because during prolonged use of hot water, such as when taking a shower, there is simply inadequate time to heat cold water entering the tank to replenish the hot water drawn from the tank. Therefore, energy used to heat water during prolonged use of the tank is largely wasted. Likewise, in some embodiments, the control unit 16 may be configured to disable the heater 15 when water is drawn from the tank 11 through the water outlet 12 in order to avoid incoming cold water cooling down the hot water as it is actually being used. To this end, a flowmeter 23 is coupled to the water outlet 12 for producing a signal indicative of water flow that is fed to the control unit as shown by the dotted line. The flowmeter 23 could equally be coupled to the water inlet 12 in series with the shut off valve 22.

Optionally, a water pump 24 may be coupled between the water outlet 12 and the water inlet 13 for re-circulating hot water in the tank. The temperature sensor 17, which may be a thermistor, is shown schematically inside the tank. But in practice, it is mounted inside a pipe through which the pump re-circulates the water from the hot to the cold side. It may also be mounted in thermal contact with an external wall of the tank via some heat sink compound to assure a good thermal contact. Hot water temperature measurement is subject to hysteresis and it can take many minutes of use before any substantive change in temperature is registered. By re-circulating hot water in the tank, the heated water mixes more quickly with the cold water and the temperature sensor 17 is able to produce a more accurate reading. In some embodiments, the pump 24 is actuated constantly in a preset duty cycle, such as 90 seconds on and 10 seconds off. However, the invention also contemplates controlled actuation of the pump 24 by the control unit 16 when the heater 15 is actuated, whereby water is circulated in the tank 11 only during heating. The control unit 16 may have a standby battery backup 25 for retaining user settings in case of an electrical power failure.

As noted above, the control unit 16 is typically programmed to initiate Sabbath mode automatically based on the time of commencement of the Sabbath, which varies throughout the year and also according to geographical location. In practice, some contingency is built into the system so that Sabbath mode is initiated before the actual time when the Sabbath commences. The reason for this is twofold: first, particularly in the summer months when the astronomical time for Sabbath is late on Friday evening, many communities bring in the Sabbath earlier. The control unit 16 may be programmed to take this into account so as to safeguard against a Sabbath-observant user from inadvertently heating water above the permissible temperature after the local community has commenced the Sabbath. Secondly, it takes time for hot water in the tank to cool down and if hot water is drawn shortly after the commencement of the Sabbath prior to the water temperature having fallen to 40° C., the cold water that replaces this hot water may then be heated on the Sabbath to above 40° C. So it is desirable to allow the water temperature to settle down to 40° C. before the onset of the Sabbath regardless of the season.

But this causes a potential problem since a user may arrive home before the onset of Sabbath and want a hot shower. If the control unit 16 is already in Sabbath mode and the water in the tank is above 40° C., the shut-off valve 22 will be closed and the user will be unable to take a shower. To alleviate this situation, an override switch 26 may be provided that causes the control unit 16 to open the shut-off valve 22 within a specified time window before the commencement of the Sabbath and thereby release hot water from the tank in the case where Sabbath mode is enabled and the temperature is over the permissible temperature. In some embodiments, the override switch 26 allows hot water to be released from the tank for a period of thirty minutes and will close again if the temperature is higher than permissible.

It will be appreciated that the control unit 16 is easily adapted for connection to existing installations and to this end the appended claims include claims directed to the control unit per se.

It will also be understood that while the invention is particularly useful for domestic applications, no such limitation is inherent and the invention may be used also for commercial applications, where it finds utility particularly related to those features that are not dependent or conditional on Sabbath use.

The invention claimed is:

1. A water heating control system comprising:

a tank for holding a volume of water, said tank having a hot water outlet and a cold water inlet connected to a main water supply whereby hot water removed from the hot water outlet is replenished with cold water, a temperature sensor for providing a temperature signal indicative of water temperature in the tank, a heater for heating the water in the tank, a control unit that monitors the water temperature based on the temperature signal and is responsive to selection of a Sabbath mode of operation for periodically actuating and de-actuating the heater while maintaining an average water temperature to less than a permitted preset threshold, a flowmeter for producing a flow signal when water is drawn from the tank, and a controllable shut off valve connected to the water inlet;

wherein when set to the Sabbath mode, the control unit is configured to close the shut off valve when the heater is actuated and to open the shut off valve when the heater is not actuated, and wherein the control unit is responsive to said flow signal for disabling the heater when water is drawn from the tank.

2. The water heating control system according to claim 1, further comprising a water pump coupled between the water outlet and the water inlet for re-circulating water in the tank.

3. The water heating control system according to claim 2, wherein the control unit is configured to activate the water pump when the heater is actuated.

4. The water heating control system according to claim 2, wherein the control unit is configured to activate the water pump constantly according to a preset duty cycle.

5. The water heating control system according to claim 1, wherein the control unit has a standby battery backup for retaining user settings in case of an electrical power failure.

6. The water heating control system according to claim 1, further including an override switch, operation of which during Sabbath mode causes the control unit to open the shut-off valve for a predetermined time.

7. The water heating control system according to claim 1, further including a mode selector for manually selecting regular use or Sabbath use.

8. The water heating control system according to claim 1, further including a programmable clock that automatically activates and deactivates Sabbath use based on a calendrical data relating to start and end times of the Sabbath.

9. A control unit for a water heating system, wherein:

the water heating system comprises:

a tank for holding a volume of water, said tank having a hot water outlet and a cold water inlet connected to a main water supply whereby hot water removed from the hot water outlet is replenished with cold water, a temperature sensor for providing a temperature signal indicative of water temperature in the tank, a heater for heating the water in the tank, and a controllable shut off valve connected to the water inlet;

wherein the control unit comprises:

a sensor input for coupling to the temperature sensor, a valve control output for coupling to the shut off valve, and a controller configured to monitor the water temperature based on the temperature signal and being responsive to a Sabbath mode of operation for periodically actuating and de-actuating the heater while maintaining an average water temperature to less than a permitted preset threshold, and for closing the shut off valve when the heater is actuated and for opening the shut off valve when the heater is not actuated.

10. The control unit according to claim 9, wherein the controller is responsive to a flow signal produced by a flowmeter for disabling the heater when water is drawn from the tank.

11. The control unit according to claim 9, wherein the controller is configured to operate a water pump for circulating water in the tank when the heater is actuated.

12. The water heating controller according to claim 9, wherein the control unit is configured to activate a water-pump constantly according to a preset duty cycle.

13. The control unit according to claim 9, wherein the controller has a standby battery backup for retaining user settings in case of an electrical power failure.

14. The control unit according to claim 9, further including an override switch, operation of which during Sabbath mode causes the control unit to open the shut-off valve for a predetermined time.

15. A water heating control system comprising:

a tank for holding a volume of water, said tank having a hot water outlet and a cold water inlet connected to a main water supply whereby hot water removed from the hot water outlet is replenished with cold water, a temperature sensor for providing a temperature signal indicative of water temperature in the tank, a heater for heating the water in the tank, a water pump coupled between the water outlet and the water inlet for re-circulating water in the tank, a control unit that monitors the water temperature based on the temperature signal and is responsive to selection of a Sabbath mode of operation for periodically actuating and de-actuating the heater while maintaining an average water temperature to less than a permitted preset threshold, and a controllable shut off valve connected to the water inlet;

wherein when set to the Sabbath mode, the control unit is configured to close the shut off valve when the heater is actuated and to open the shut off valve when the heater is not actuated.

16. The water heating control system according to claim 15, wherein the control unit is configured to activate the water pump when the heater is actuated.

17. The water heating control system according to claim 15, wherein the control unit is configured to activate the water pump constantly according to a preset duty cycle.

18. The water heating control system according to claim 15, further including an override switch, operation of which during Sabbath mode causes the control unit to open the shut-off valve for a predetermined time.

19. The water heating control system according to claim 15, further including a programmable clock that automatically activates and deactivates Sabbath use based on a calendrical data relating to start and end times of the Sabbath.

20. A water heating control system comprising:

a tank for holding a volume of water, said tank having a hot water outlet and a cold water inlet connected to a main water supply whereby hot water removed from the hot water outlet is replenished with cold water, a temperature sensor for providing a temperature signal indicative of water temperature in the tank, a heater for heating the water in the tank, a control unit that monitors the water temperature based on the temperature signal and is responsive to selection of a Sabbath mode of operation for periodically actuating and de-actuating the heater while maintaining an average water temperature to less than a permitted preset threshold, a controllable shut off valve connected to the water inlet, and an override switch, operation of which during Sabbath mode causes the control unit to open the shut-off valve for a predetermined time;

wherein when set to the Sabbath mode, the control unit is configured to close the shut off valve when the heater is actuated and to open the shut off valve when the heater is not actuated.

21. The water heating control system according to claim 20, further including a programmable clock that automatically activates and deactivates Sabbath use based on a calendrical data relating to start and end times of the Sabbath.

* * * * *